US005570583A

United States Patent [19]

Boehde et al.

[11] Patent Number: 5,570,583

[45] Date of Patent: Nov. 5, 1996

[54] COOLING OF COMPRESSOR LUBRICANT IN A REFRIGERATION SYSTEM

[75] Inventors: Michael C. Boehde, Onalaska; James W. Larson, La Crosse, both of Wis.

[73] Assignee: American Standard Inc., Piscataway, N.J.

[21] Appl. No.: 400,684

[22] Filed: Mar. 8, 1995

Related U.S. Application Data

[62] Division of Ser. No. 296,986, Aug. 26, 1994, Pat. No. 5,419,155, which is a continuation of Ser. No. 40,757, Mar. 31, 1993, abandoned.

[51] Int. Cl.[6] ..... F25B 43/02

[52] U.S. Cl. ..... 62/84; 62/470; 62/472; 62/507

[58] Field of Search ..... 62/84, 193, 468, 62/469, 470, 473, 506, 507

[56] References Cited

U.S. PATENT DOCUMENTS

| | | | |
|---|---|---|---|
| 1,870,457 | 8/1932 | Kenney | 62/84 |
| 4,916,914 | 4/1990 | Short | 62/84 |

FOREIGN PATENT DOCUMENTS

| | | |
|---|---|---|
| 2261091 | 6/1973 | Germany . |
| 0033151 | 3/1977 | Japan . |

*Primary Examiner*—John M. Sollecito

*Attorney, Agent, or Firm*—William J. Beres; William O'Driscoll; Peter D. Ferguson

[57] ABSTRACT

Compressor lubricant in a screw compressor-based refrigeration system is cooled by directing the lubricant from the system oil separator to an oil-cooling heat exchanger disposed in the lower portion of the system condenser where it is bathed in condensed system refrigerant. Parasitic capacity losses with respect to the compressor lubricant cooling process are thereby avoided.

8 Claims, 2 Drawing Sheets

COOLING OF COMPRESSOR LUBRICANT IN A REFRIGERATION SYSTEM

This patent is derived from a divisional patent application of allowed U.S. patent application 08/296,986 filed Aug. 26, 1994, which is now U.S. Pat. No. 5,419,155, which is a continuation of U.S. patent application 08/040,757, filed Mar. 31,1993 now abandoned.

FIELD OF THE INVENTION

The present invention relates to the cooling of compressor lubricant in a refrigeration system. More specifically, the present invention relates to the cooling of compressor lubricant by directing it from the system compressor or oil separator to a lubricant cooling heat exchanger which is bathed in liquid refrigerant in the condenser of a refrigeration system.

BACKGROUND OF THE INVENTION

Many compressors, including those used in refrigeration and air conditioning systems, are such that the cooling of its lubricant is required in conjunction with the use of the compressor in a particular application. The need to separate and cool the compressor lubricant in a screw compressor-based refrigeration system is particularly acute given the large amount of oil which is used for various purposes in screw compressors.

The use of system refrigerant for compressor lubricant cooling purposes is advantageous as is heretofore known. In that regard, U.S. Pat. No. 320,308 teaches a refrigeration system in which liquid refrigerant is directed from the system condenser into a separate cooling tank where compressor lubricant is cooled by direct contact with the refrigerant.

U.S. Pat. No. 3,509,731 teaches an air-cooled condenser in which a discrete portion of the condenser is dedicated to lubricant cooling. System refrigerant is directed out of the condenser, into the compressor sump, where it cools the compressor lubricant, and back to the condenser. U.S. Pat. No. 3,548,612 is directed to generally the same subject matter as the aforementioned '731 patent although it teaches the use of an ejector to pump refrigerant from the system condenser to the compressor sump prior to the refrigerant's return to the condenser.

In U.S. Pat. No. 3,820,350 lubricant is directed from an oil separator to a heat exchanger into which liquid refrigerant is directed from a refrigeration system condenser. The liquid refrigerant cools the lubricant and vaporized refrigerant is returned to the compressor at an intermediate pressure location.

U.S. Pat. No. 4,419,865 teaches a screw compressor-based refrigeration system in which liquid refrigerant is directed from the system condenser into a refrigerant receiver. Liquid refrigerant is pumped from the receiver, undergoes a heat exchange relationship with compressor lubricant and is then injected into the compressor discharge line in a metered quantity so as to maintain a constant temperature in the oil-refrigerant mixture discharged from the compressor.

U.S. Pat. No. 4,448,244 teaches a segmented refrigeration system condenser in which system refrigerant passes through a first condenser section, where it is condensed by relatively warmer water, and is then directed into the sump of the system compressor where it cools the compressor lubricant. The refrigerant is next directed out of the compressor to the second portion of the system condenser where it undergoes further heat exchange contact with the condenser cooling water at a location where the water is relatively cooler.

Finally, U.S. Pat. No. 4,558,573 teaches a condenser in a refrigeration system from which liquid refrigerant is drained to a receiver. The receiver and system oil separator are connected to an ejector. The flow of oil from the separator through the ejector draws liquid refrigerant from the receiver with the result that the oil and liquid refrigerant mix in a manner which cools the oil prior to its return to various compressor locations.

The need continues to exist for an efficient and cost effective oil cooling arrangement in a screw compressor-based refrigeration system which avoids the parasitic loss of system capacity typical of previous systems including those where the cooling of compressor lubricant occurs in, or as a result of, heat exchange contact with refrigerant in the system evaporator.

SUMMARY OF THE INVENTION

It is an object of the present invention to provide for lubricant cooling in a screw compressor-based refrigeration system in a manner which avoids the parasitic loss of system capacity associated with known compressor lubricant cooling systems and arrangements.

It is another object of the present invention to provide a more efficient oil cooling arrangement for a screw compressor-based refrigeration system which, additionally, is cost advantageous over and more easily fabricated than existing oil cooling systems and arrangements.

The objects of the present invention are accomplished by the disposition of an oil-cooling heat exchanger in the condenser of a screw compressor-based refrigeration system. The oil-cooling heat exchanger is disposed in the lower portion of the system condenser, which contains liquid refrigerant when the system is in operation, so as to be bathed in liquid refrigerant. Compressor lubricant is directed from the system oil separator to the oil-cooling heat exchanger where lubricant heat is rejected to the surrounding liquid refrigerant in the condenser.

The rejection of the lubricant's heat to the pooled liquid refrigerant in the condenser causes a portion of the liquid refrigerant to re-vaporize. The re-vaporized refrigerant then re-condenses, still within the condenser, thereby avoiding the parasitic loss of system capacity typically found in other compressor oil cooling arrangements in refrigeration systems.

The cooled compressor lubricant is directed from the system condenser back to the compressor where it is re-employed for purposes such as bearing lubrication, sealing and cooling.

DESCRIPTION OF THE DRAWING FIGURES

DESCRIPTION OF THE PREFERRED EMBODIMENT

Figure 4:
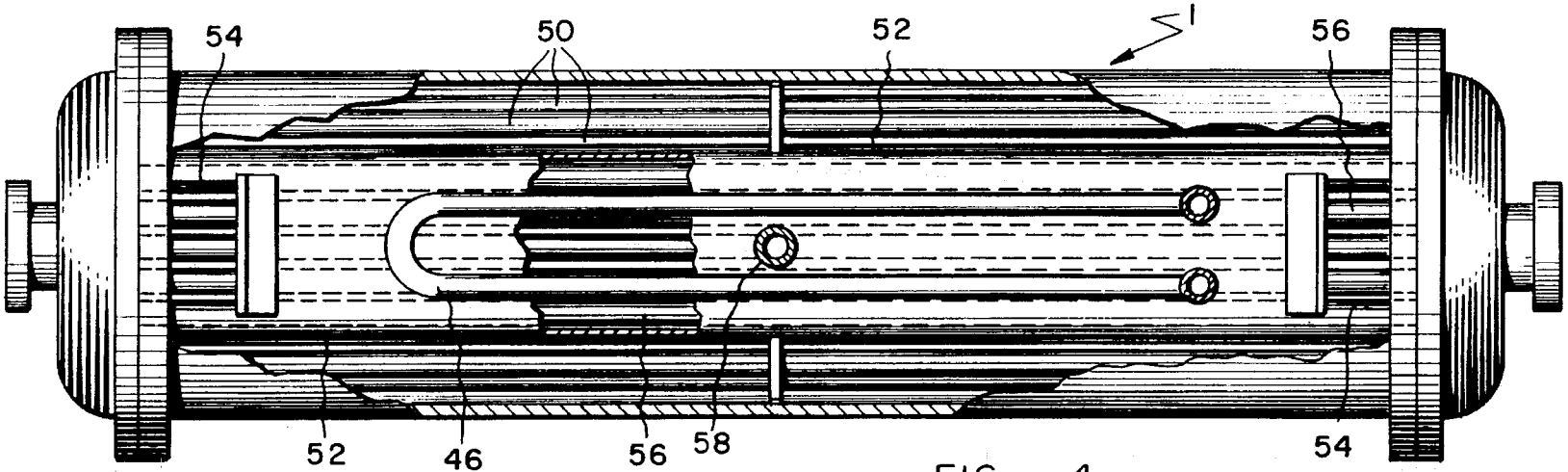
FIG. 4 is taken along line 4—4 of FIG. 2.
Figure 1:
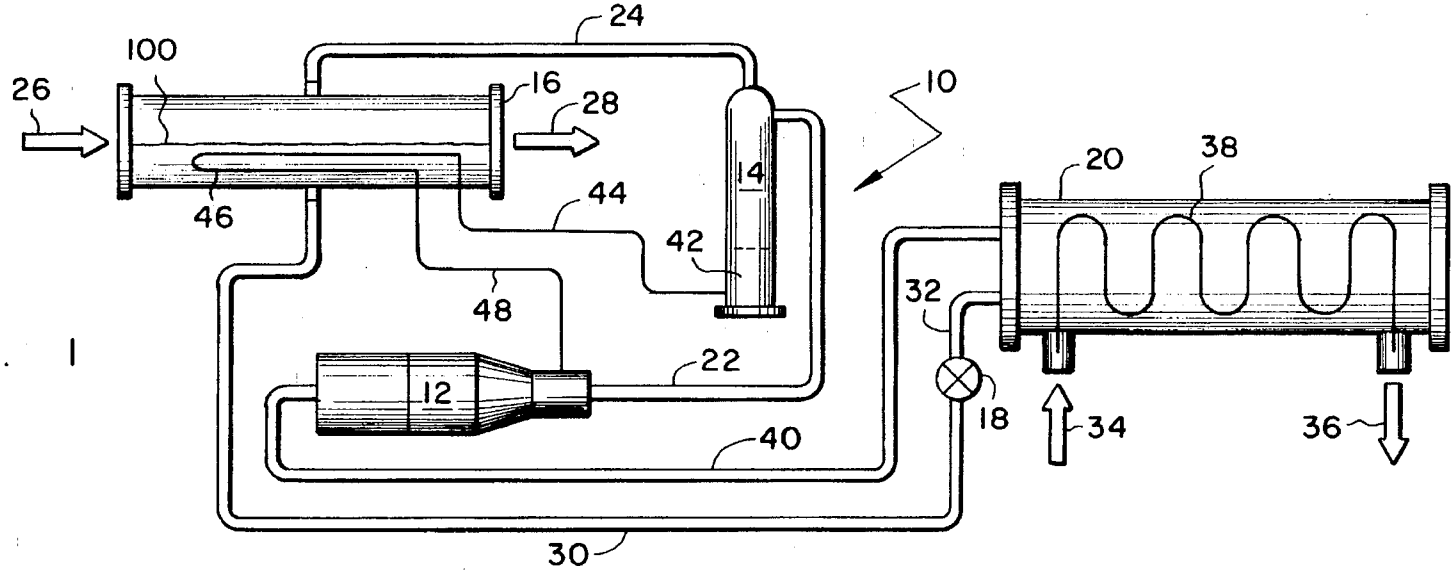
FIG. 1 is a schematic illustration of a refrigeration system of the present invention.

Referring concurrently to all of the drawing figures, refrigeration system 10 is comprised of compressor 12, oil separator 14, condenser 16, metering device 18 and evaporator 20 all of which are serially connected with respect to refrigerant flow. In the system of the preferred embodiment, compressor 12 is an oil-injected rotary screw compressor.

A mixture of oil-laden compressed refrigerant gas passes from compressor 12 through conduit 22 to system oil separator 14. In the preferred embodiment, oil separator 14 is a discrete component of refrigeration system 10 although it will be recognized that in many screw compressor-based refrigeration systems, such as the one taught in U.S. Pat. No. 4,662,190 which is assigned to the assignee of the present invention and is incorporated herein by reference, the oil separator and compressor are integral.

Hot, compressed refrigerant gas from which oil has been separated passes from the oil separator through conduit 24 to system condenser 16. In the preferred embodiment, condenser 16 is a water cooled condenser with arrows 26 and 28 representing the flow of cooling water through condenser 16. The hot, compressed refrigerant gas directed into the condenser rejects its heat to the cooling medium (water) and is condensed in the process.

The condensed liquid refrigerant falls, by force of gravity, to the lower portion of condenser 16 where it pools. The liquid level of the condensed refrigerant within condenser 16 is indicated by reference numeral 100.

The pooled liquid refrigerant passes out of condenser 16 to metering device 18 via conduit 30. The condensed refrigerant, in passing through metering device 18, is further cooled by its expansion therethrough and is next directed through conduit 32 into system evaporator 20.

In the preferred embodiment of the present invention, the air conditioning or refrigeration load on system 10, represented by arrows 34 and 36, is cooled by the rejection of its heat to the now relatively cool system refrigerant flowing into and through evaporator 20. Arrows 34 and 36 represent the flow of water across the tubes 38 internal of evaporator 20. Chilled water is directed out of the evaporator for further use such as in the comfort conditioning a building or in an industrial process.

The rejection of heat from the system load into the system refrigerant within evaporator 20 causes the refrigerant to be vaporized within the evaporator. The refrigerant vapor is then returned, through conduit 40, to compressor 12 for recompression.

The oil which is separated by oil separator 14 from the mixture of compressed refrigerant vapor and entrained oil which leaves compressor 12 collects in the sump 42 of oil separator 14. As will be apparent, oil separator 14 is at discharge pressure when compressor 12 is in operation.

In the present invention, the hot oil collected in oil separator 14 at discharge pressure is urged by such pressure through oil conduit 44 into an oil-cooling heat exchanger 46 in condenser 16. Because of the relative temperatures of the oil directed from oil separator 14 into heat exchanger 46 and the condensed system refrigerant in which heat exchanger 46 is bathed within condenser 16, heat from the relatively warmer compressor lubricant is rejected to the condensed system refrigerant thereby cooling the compressor lubricant.

The lubricant is urged out of the condenser through conduit 48 and back to compressor 12, after having been cooled, where it is reused for the various purposes mentioned above. It is to be noted that in the preferred embodiment it is the differential pressure which exists between the interior of oil separator 14 and the various locations within compressor 12 to which the cooled lubricant is ultimately directed which causes lubricant to flow from oil separator 14, to and through oil-cooling heat exchanger 46 in condenser 16 and back to compressor 12. It will be appreciated that it may be necessary or advantageous, in some applications, to move the oil from the interior of oil separator 14 back to compressor 12 after being cooled by mechanical means such as by a pump (not shown) or by other means.

Figure 2:
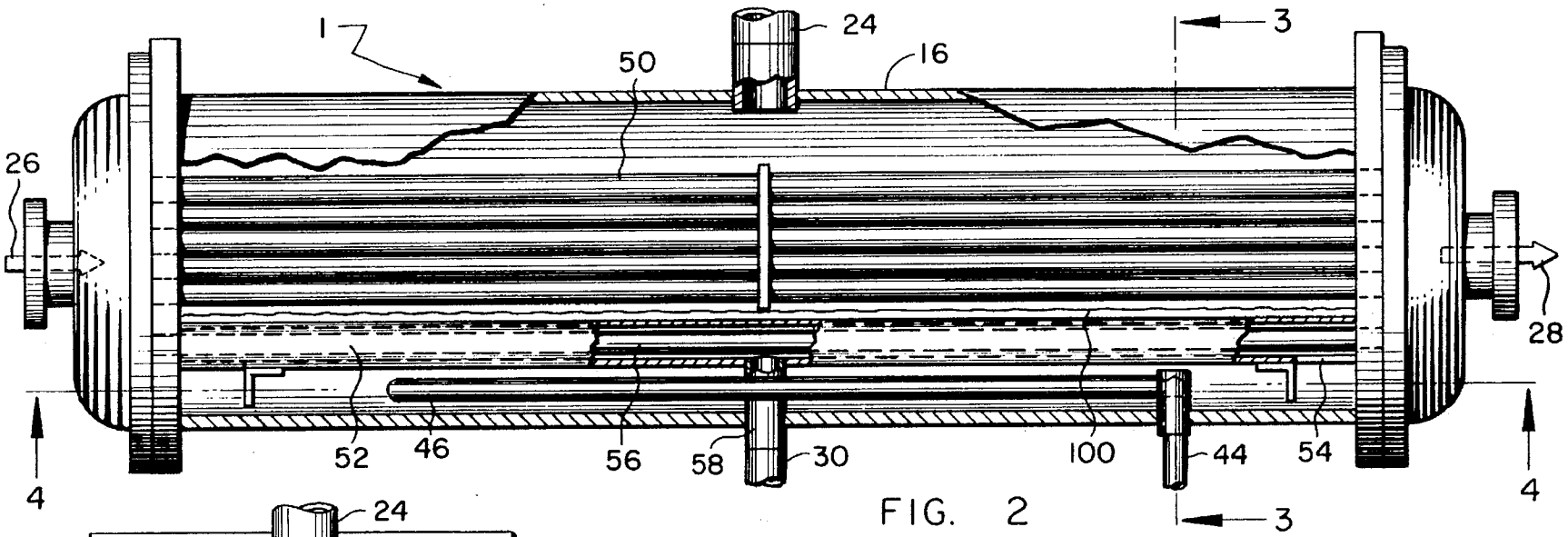
FIG. 2 is a partial sectional view of the condenser of the refrigeration system of FIG. 1.
Figure 3:
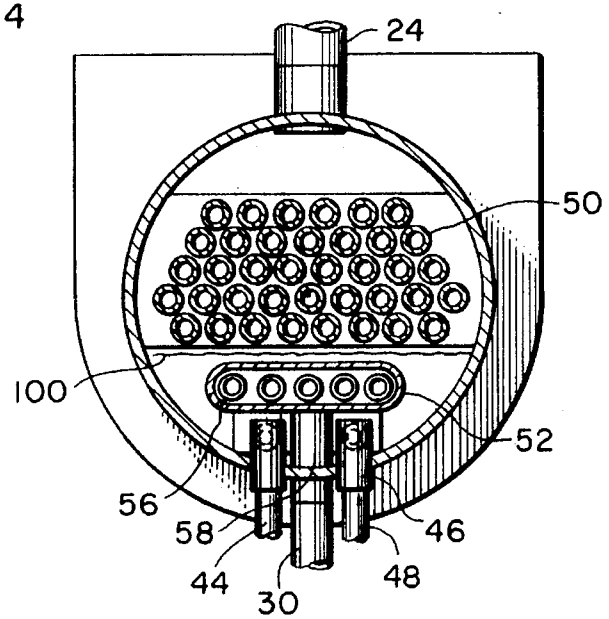
FIG. 3 is taken along line 3—3 of FIG. 2.

Referring now primarily to FIGS. 2, 3 and 4, the structure and function of condenser 16, particularly with respect to its oil cooling function, will be further explained. Condenser 16 is a heat exchanger of the shell and tube type in 0 which a cooling medium is directed through a primary tube bundle for heat exchange with gaseous system refrigerant. In that regard, the cooling medium, in this case water represented by arrows 26 and 28, enters a distribution chamber at a first end of condenser 16 where it is directed into and through tube bundle 50. The cooling medium is also directed, however, into a discrete subcooling heat exchanger 52 the purpose and function of which will later be described. After passing through tube bundle 50 and subcooler 52, the cooling medium re-collects and flows out of condenser 16 having been heated by the rejection of the system refrigerant vapor's heat into it.

As was earlier suggested, hot compressed system refrigerant in the form of a vaporized gas enters the upper portion of condenser 16 from conduit 24 and undergoes a heat exchange relationship with the cooling medium flowing through the tube bundle 50. A distribution baffle, not shown, may be mounted in the upper portion of condenser 16 to evenly distribute refrigerant vapor with respect to the tube bundle.

The hot refrigerant vapor is cooled and condenses to liquid form on the surface of the tubes which comprise tube bundle 50 and falls to the lower portion of condenser 16 where it pools. The pooled refrigerant, in the preferred embodiment, surrounds subcooling heat exchanger 52 as well as oil cooling heat exchanger 46, all in the lower portion of condenser 16. The level of the condensed liquid refrigerant within condenser 16 is, once again, indicated by liquid level 100 in the drawing figures.

The condensed refrigerant within condenser 16 flows into subcooling heat exchanger 52 through openings 54 such that prior to passing out of condenser 16 to metering device 18, the condensed refrigerant undergoes still further cooling in a second exchange of heat with the cooling medium, which is at a temperature still lower than that of the condensed refrigerant, flowing through the tubes 56 of the subcooling heat exchanger. The subcooled liquid refrigerant then passes out of condenser 16 and into conduit 30 via conduit connection 58 for delivery to the metering device.

With regard to the hot compressor lubricant which passes from oil separator 14 into and through oil-cooling heat exchanger 46 in condenser 16, it will be appreciated that the relatively hot oil flowing through oil cooling heat exchanger 46 rejects its heat to the relatively cooler condensed system refrigerant within which it is bathed. The exchange of heat between the relatively hot compressor lubricant and the relatively cool liquid refrigerant pooled at the bottom of condenser 16 causes a portion of the liquid refrigerant to vaporize. The refrigerant so vaporized passes out of the pool of liquid refrigerant in the lower portion of the condenser and into the upper portion of the condenser where it mixes with the refrigerant vapor being delivered to the condenser from the oil separator during system operation.

The refrigerant vaporized in the lower portion of condenser 16 by the exchange of heat between compressor lubricant and condensed system refrigerant then undergoes, for a second time but still within the system condenser, an exchange of heat with the cooling medium flowing through tube bundle 50. As such, the refrigerant used to cool the compressor lubricant is recondensed and falls back into the pool of liquid refrigerant in a process which is, once again, confined to the interior of the system condenser. It will be appreciated that by cooling compressor lubricant in this manner, parasitic losses in system capacity with respect to the lubricant cooling process are avoided.

It will be noted that several distinct heat exchange processes are ongoing within condenser 16. A first exchange of heat occurs between the condenser cooling medium and vaporized system refrigerant as it first enters condenser 16. A second exchange of heat is between the condenser cooling medium and the condensed system refrigerant in subcooling heat exchanger 52.

A third exchange of heat is between the compressor lubricant and the condensed system refrigerant in oil cooling heat exchanger 46. A fourth exchange of heat is between the refrigerant which is re-vaporized in the oil cooling process and the cooling medium passing through tube bundle 50. That portion of the refrigerant will have undergone two distinct exchanges of heat with the cooling medium passing through tube bundle 50 and still another with the cooling medium passing through subcooling heat exchanger 52 prior to exiting condenser 16 in liquid form.

It will be appreciated that condenser 16 has three discrete heat exchangers, the first being the condenser cooling medium-refrigerant vapor heat exchanger which is comprised of tube bundle 50 disposed in the upper portion of condenser 16. The second is condenser cooling medium-liquid refrigerant subcooling heat exchanger 52 disposed in the lower portion of condenser 16. The third is compressor lubricant-liquid refrigerant heat exchanger 46, disposed in the lower portion of condenser 16, the purpose of which, as previously described, is to cool compressor lubricant.

While the present invention has been described in terms of a preferred embodiment, its scope is not limited thereto but is in accordance with the language of the claims that follow:

What is claimed is:

1. A method of cooling compressor lubricant in a refrigeration system comprising the steps of:

condensing system refrigerant in a heat exchanger;

directing compressor lubricant to the condensing heat exchanger;

passing said compressor lubricant in a heat exchange relationship with condensed system refrigerant in said condensing heat exchanger so as to cool said lubricant, a portion of said condensed system refrigerant being vaporized by the cooling of said lubricant; and returning said cooled compressor lubricant to said compressor for further use therein.

2. The method according to claim 1 further comprising the steps of compressing refrigerant gas in a manner which causes compressor lubricant to be entrained therein and directing said mixture of compressed refrigerant gas and entrained lubricant to a lubricant separator.

3. The method according to claim 2 further comprising the step of separating the lubricant from said mixture, said step of directing compressor lubricant to the condensing heat exchanger including the step of directing separated compressor lubricant from said lubricant separator to said condensing heat exchanger.

4. The method according to claim 1 further comprising the step of recondensing the refrigerant vaporized in said passing step within said heat exchanger.

5. The method according to claim 1 comprising the further step of recondensing said portion of said condensed system refrigerant which is vaporized during the cooling of said lubricant within said condenser.

6. The method according to claim 1 comprising the further step of subcooling said condensed system refrigerant within said condensing heat exchanger prior to the exit of said condensed system refrigerant therefrom.

7. The method according to claim 1 wherein said directing step includes the step of exposing said compressor lubricant to a pressure sufficient to drive said lubricant to said condensing heat exchanger.

8. The method according to claim 1 wherein said passing step includes the step of bathing a lubricant-cooling heat exchanger in said condensed system refrigerant and wherein said compressor lubricant directed to said condensing heat exchanger by said directing step is directed into said lubricant-cooling heat exchanger.

* * * * *